US008037908B1

(12) United States Patent
Green et al.

(10) Patent No.: US 8,037,908 B1
(45) Date of Patent: Oct. 18, 2011

(54) SLIDE VALVE FOR A BOTTLE

(76) Inventors: Scott David Green, Birmingham, AL (US); Joseph Michael Wyatt, Pinson, AL (US)

( * ) Notice: Subject to any disclaimer, the term of this patent is extended or adjusted under 35 U.S.C. 154(b) by 1044 days.

(21) Appl. No.: 11/868,602

(22) Filed: Oct. 8, 2007

(51) Int. Cl.
*B67C 3/34* (2006.01)

(52) U.S. Cl. ..... 141/284; 141/18; 222/165

(58) Field of Classification Search ..... 141/18, 141/22, 250, 267, 269, 271, 275, 284, 346, 141/363; 222/160, 164–167
See application file for complete search history.

(56) References Cited

U.S. PATENT DOCUMENTS

| | | | | |
|---|---|---|---|---|
| 2,128,488 | A | 8/1938 | Koerner | |
| 3,254,802 | A | 6/1966 | Barnes | |
| 3,822,032 | A | 7/1974 | Vergobbi | |
| 3,923,085 | A | 12/1975 | Nimer | |
| 4,942,432 | A * | 7/1990 | Mort et al. | 399/106 |
| 5,480,063 | A | 1/1996 | Keyes | |
| 5,542,412 | A | 8/1996 | Century | |
| 5,725,131 | A | 3/1998 | Bell | |
| 6,047,746 | A | 4/2000 | Green | |
| 6,189,742 | B1 | 2/2001 | Thomson et al. | |
| 6,253,959 | B1 | 7/2001 | Gaultney | |
| 6,315,170 | B1 | 11/2001 | Thomson et al. | |
| 6,352,183 | B1 * | 3/2002 | Kristiansen et al. | 222/325 |
| 6,371,331 | B1 | 4/2002 | Gohde | |
| 6,619,510 | B2 | 9/2003 | Green | |
| 7,434,603 | B2 * | 10/2008 | Spear et al. | 141/363 |
| 2007/0113924 | A1 | 5/2007 | Phillips, Jr. | |

* cited by examiner

*Primary Examiner* — Gregory Huson
*Assistant Examiner* — Jason Niesz
(74) *Attorney, Agent, or Firm* — Kenneth M. Bush; Gerald M. Walsh; Bush Intellectual Property Law

(57) ABSTRACT

A slide valve system for a powder or liquid reservoir bottle which closes the reservoir bottle and allows the reservoir bottle to be tipped away from a subjacent dispensing bottle fed by the reservoir bottle. Once the reservoir bottle is tipped away the slide valve can be opened and the reservoir bottle filled. The reservoir bottle can then be closed by the slide valve and tipped back onto the dispensing bottle. Once on top of the dispensing bottle the valve can be opened and the contents of the reservoir bottle can enter the dispensing bottle by gravity flow. The slide valve must be closed in order to rotate the reservoir bottle away from the dispensing bottle. Likewise, the reservoir bottle must be locked in a vertical position with the reservoir bottle over the dispensing bottle in order to open the slide valve.

17 Claims, 9 Drawing Sheets

SLIDE VALVE FOR A BOTTLE

FIELD OF THE INVENTION

The present invention relates to dispensing machines, and more particularly, to a dispensing machine having a slide valve which closes a reservoir bottle to prevent spillage from the reservoir bottle as it is replaced or refilled.

BACKGROUND OF THE INVENTION

Powders or liquids can be dispensed from dispensing bottles in vending machines and the like. It is convenient to have a reservoir bottle above the dispensing bottle to keep the dispensing bottle filled at all times. The reservoir bottle can be removed, filled, and attached to the dispensing bottle as needed so that the dispensing operation is never interrupted. However, the reservoir bottle often needs to be tipped away from or onto the dispensing bottle to disengage or engage the dispensing bottle. During this procedure material can spill out of the reservoir bottle. A simple and practical valve system to open or close the reservoir bottle during the process of removing or connecting the reservoir bottle to the dispensing bottle would provide a cleaner and safer filling procedure.

SUMMARY OF THE INVENTION

The present invention is a slide valve for a reservoir bottle which closes the reservoir bottle and allows the reservoir bottle to be tipped away from a dispensing bottle fed by the reservoir bottle. This closure of the reservoir bottle prevents spillage of the reservoir bottle as it is tipped away from or onto the dispensing bottle. Once the reservoir bottle is tipped away the valve can be opened and the reservoir bottle filled. The reservoir bottle can then be closed by the valve and tipped back onto the dispensing bottle. Once on top of the dispensing bottle the valve can be opened and the contents of the reservoir bottle can enter the dispensing bottle by gravity flow. The sliding valve has a housing with a valve plate. The housing is attached to a rotatable reservoir bottle support plate which holds the reservoir bottle. The housing has a valve handle which opens and closes the valve plate over an opening in the sliding valve. A lock handle is attached to an operating arm assembly which is rotatably attached to the reservoir bottle support plate to lock the reservoir bottle support plate into a fixed vertical position to an upper support plate. The valve handle opens the valve plate only when the reservoir bottle support plate is locked in the vertical position to the upper support plate, and the reservoir bottle support plate is unlocked from the upper support plate only when the valve handle closes the valve plate over the opening in the sliding valve. Consequently, the slide valve must be closed in order to unlock the reservoir bottle support plate from the upper support plate to rotate the reservoir bottle away from the dispensing bottle. Likewise, the reservoir bottle support plate must be locked in a vertical position with the reservoir bottle over the dispensing bottle in order to open the slide valve.

An advantage of the present invention is a valve that allows a reservoir bottle to be removed from or placed onto a dispensing bottle without spillage from the reservoir bottle.

Another advantage is a slide valve of simple inexpensive construction that can be operated manually.

Another advantage is a slide valve that can be used on any size bottle.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
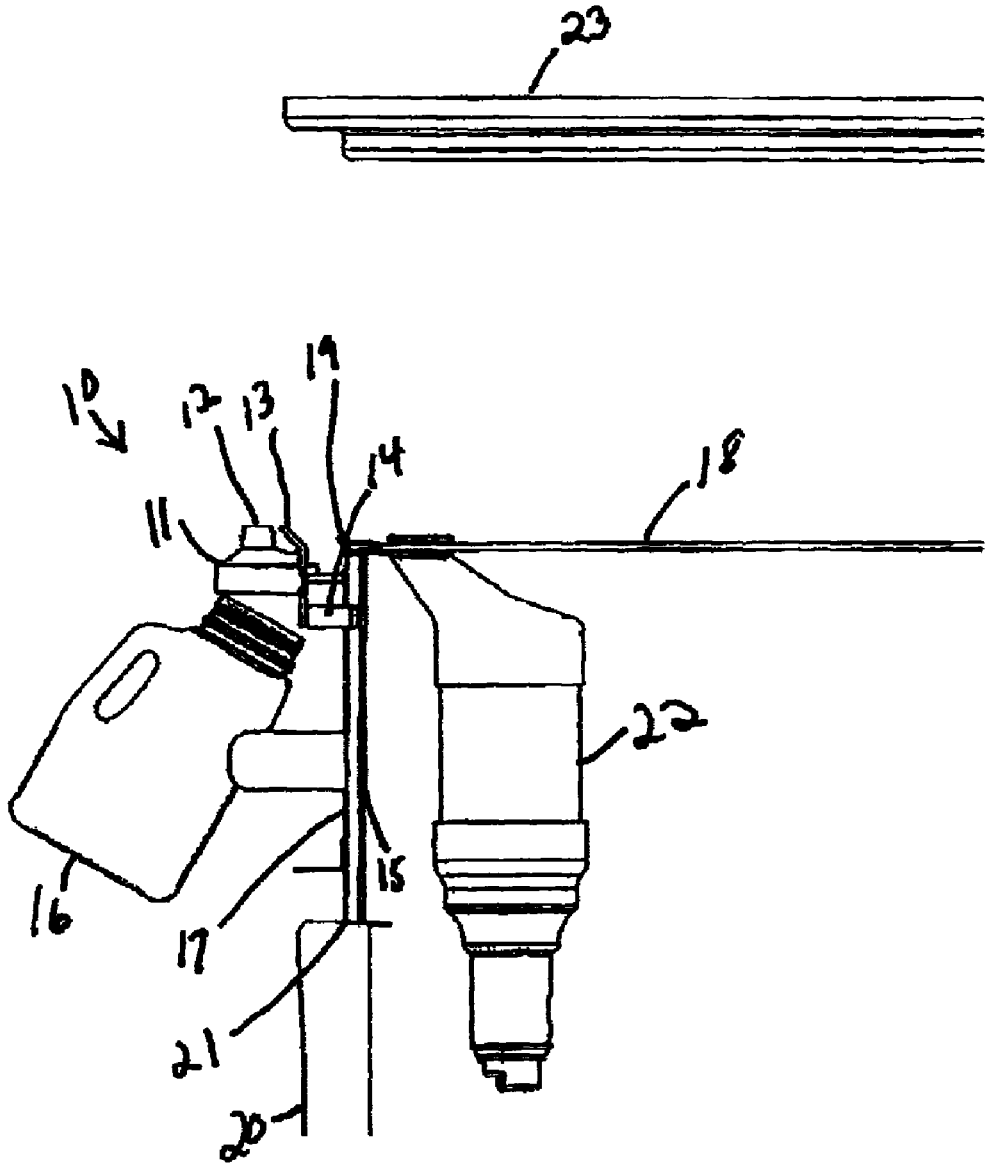
FIG. 1 shows a view of a reservoir bottle being inserted into a reservoir bottle support plate, with the opening of the reservoir bottle engaging the valve housing.
Figure 2:
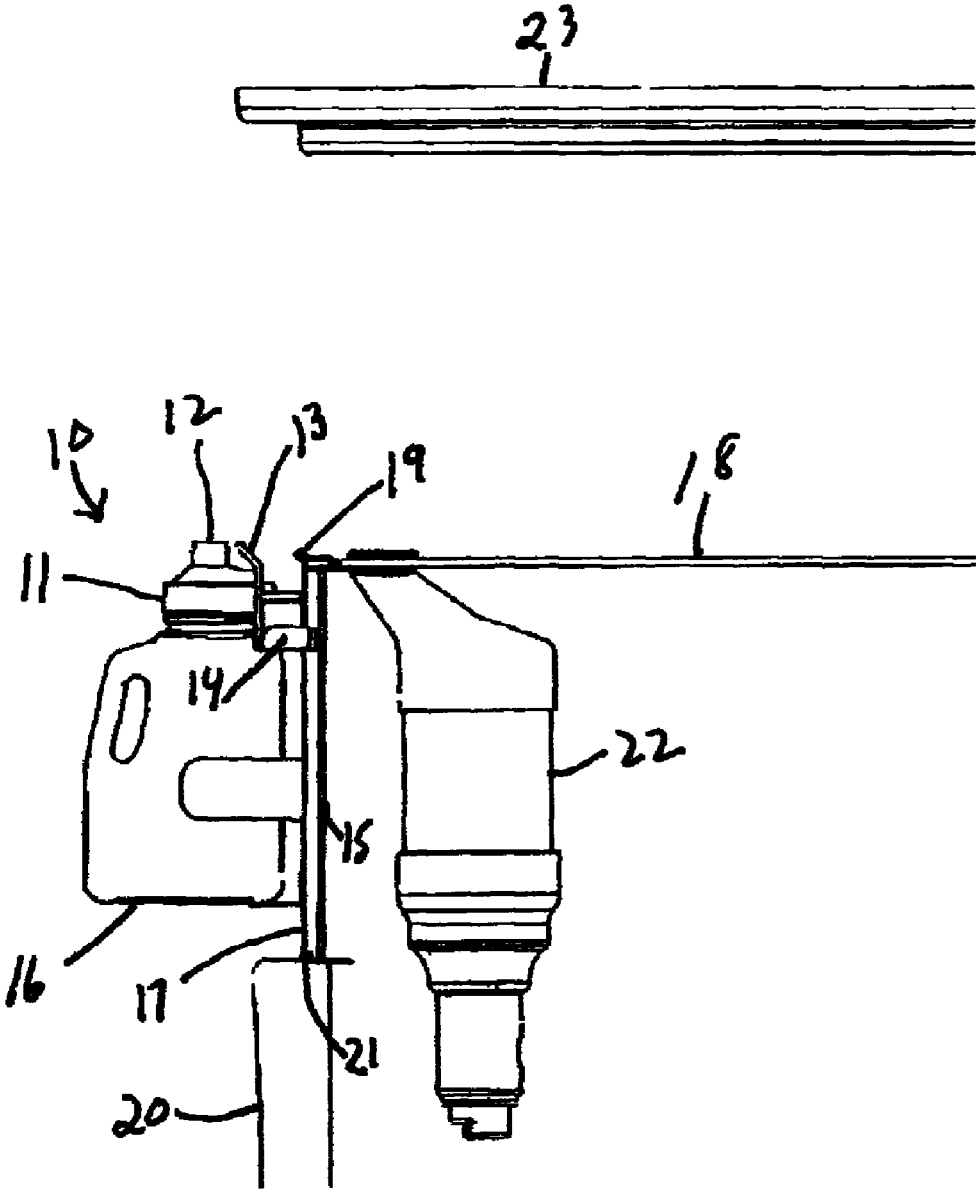
FIG. 2 shows the reservoir bottle fully inserted into the reservoir bottle support plate.
Figure 3:
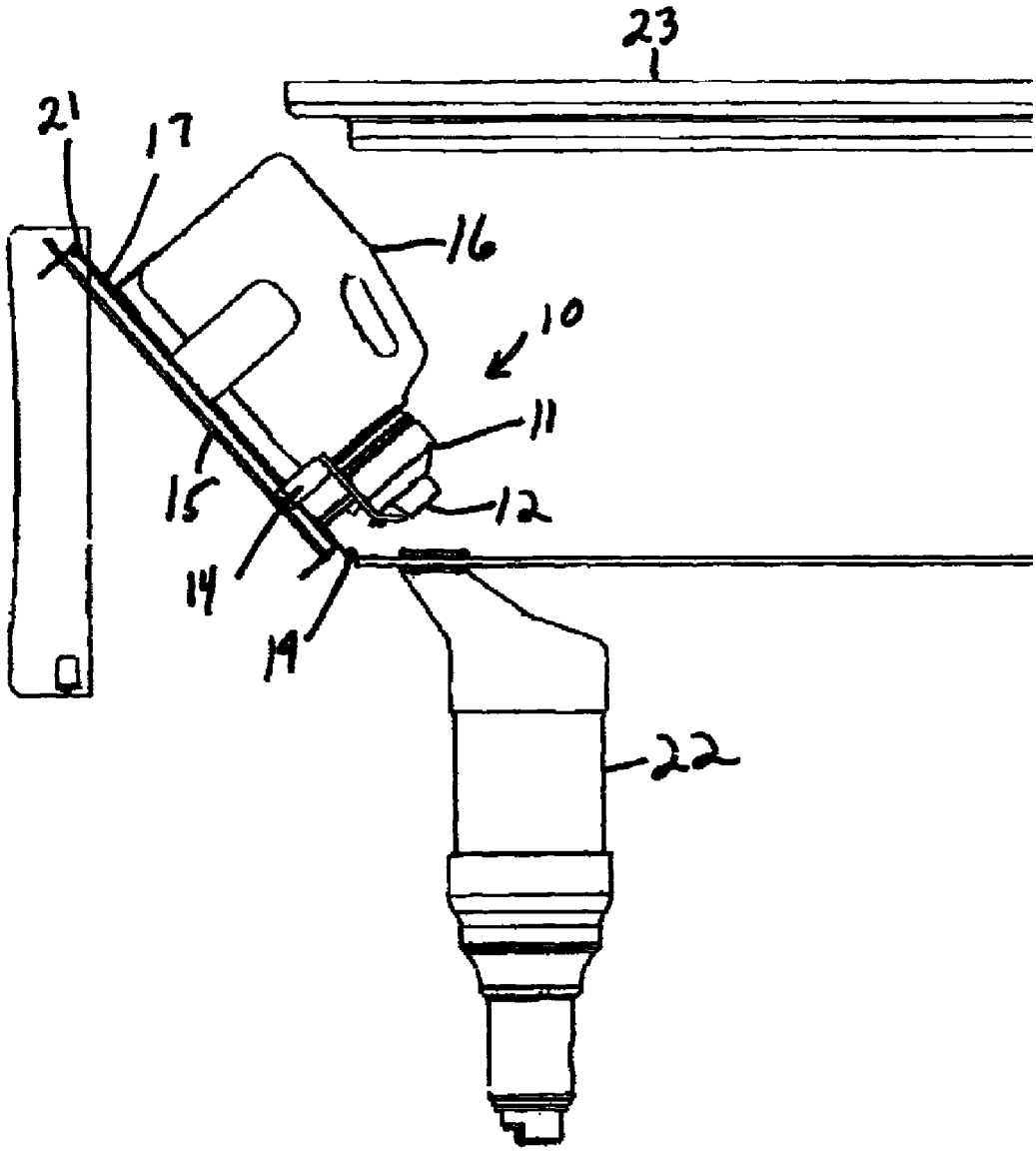
FIG. 3 shows the reservoir bottle support plate being rotated upwards to invert the reservoir bottle, with a cover rotating towards the reservoir bottle support plate.

FIG. 1 shows a view of a reservoir bottle 16 being inserted into a reservoir bottle support plate 17, with the opening of the reservoir bottle 16 engaging the valve housing 11 of the slide valve 10 of the present invention. The reservoir bottle support plate 17 is rotatably hinged to a dispensing bottle support plate 18 by means of hinge 19. A dispensing bottle 22 is suspended from dispensing bottle support plate 18. A cover 20 is hinged rotatably to reservoir bottle support plate 17 by means of hinge 21. Slide valve 10 is attached to reservoir bottle support plate 17. Slide valve 10 has a housing 11 which has a valve plate 12 on one end and an opening on the other end which engages the opening of reservoir bottle 16. The end having valve plate 12 engages an opening in dispensing bottle 22. The housing has valve handle 13 to open and close the slide valve by moving the valve plate 12. A lock handle 14 is connected to an operating arm assembly 15 which is attached rotatably to reservoir bottle support plate 17. Reservoir bottle support plate 17 engages an upper support plate 23 as reservoir bottle support plate 17 is rotated upwards. FIG. 2 shows reservoir bottle 16 in a vertical upright position fully engaged to the slide valve 10. FIG. 3 shows the reservoir bottle support plate 17 rotated upwards towards support plate 23, as reservoir bottle 16 becomes inverted. Because valve plate 12 is covering the opening in slide valve 10, there is no spillage of the contents of reservoir bottle 16 as it becomes inverted.

Figure 4:
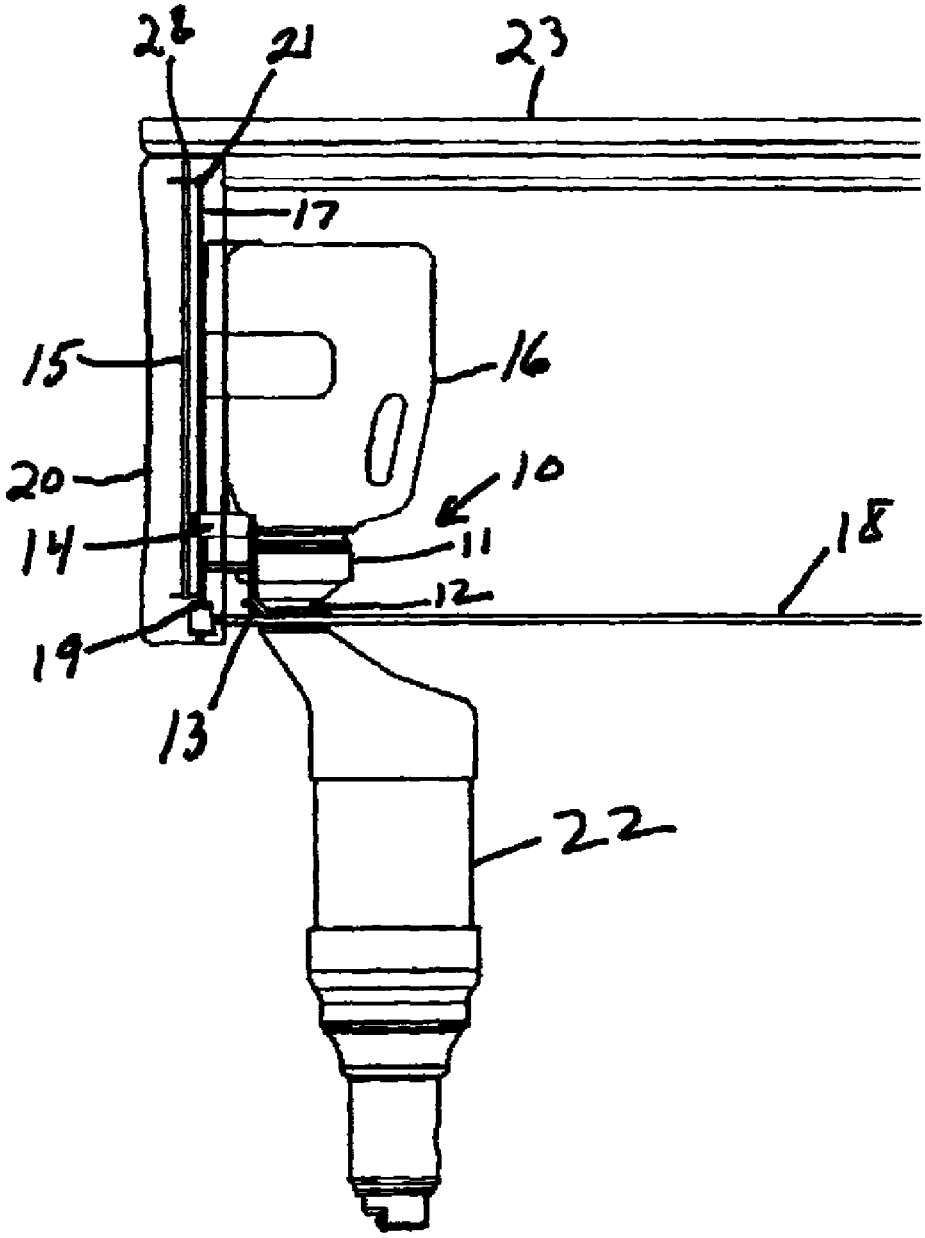
FIG. 4 shows the reservoir bottle support plate in a fully vertical position with the reservoir bottle over a dispensing bottle, the cover over the reservoir bottle support plate, and the reservoir bottle support plate in an unlocked position.
Figure 5:
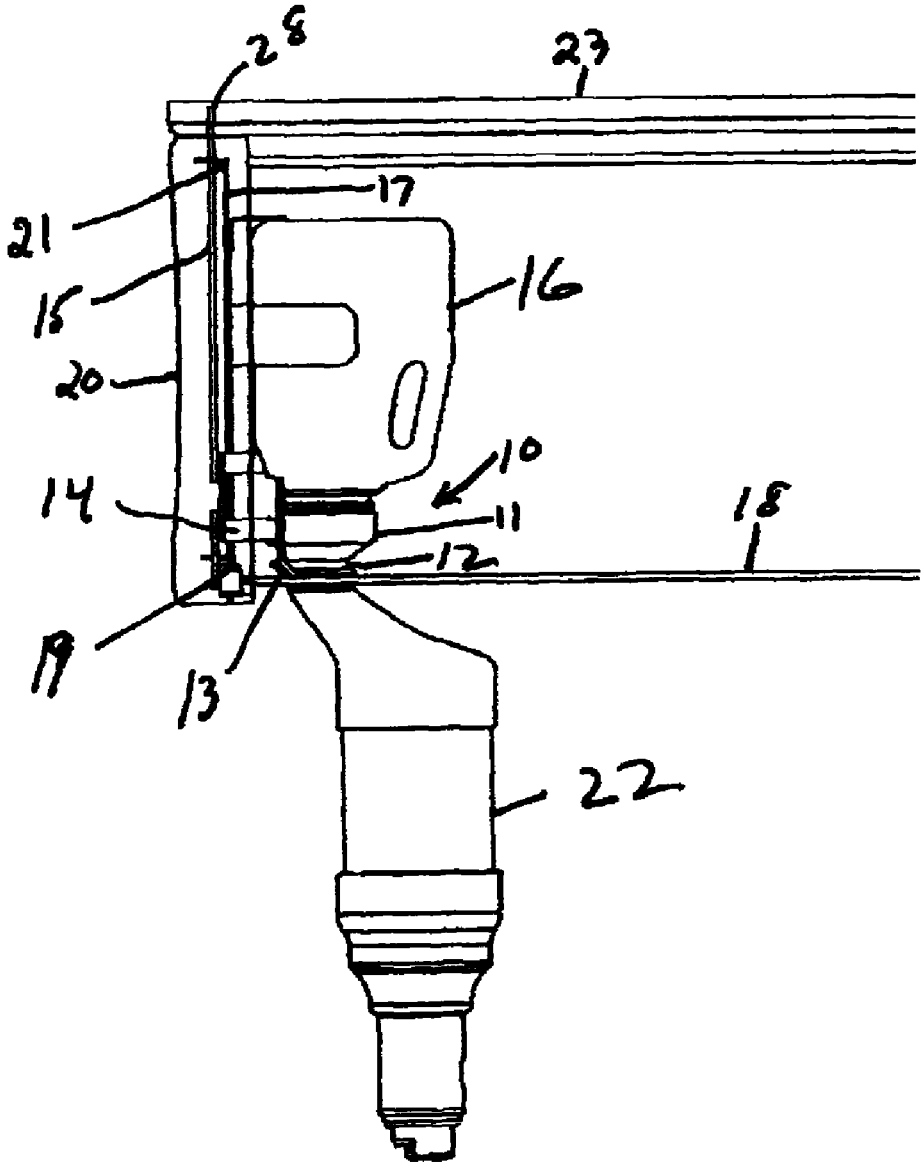
FIG. 5 shows the reservoir bottle support plate in a vertical position locked to an upright support plate, with the slide valve closed.
Figure 6:
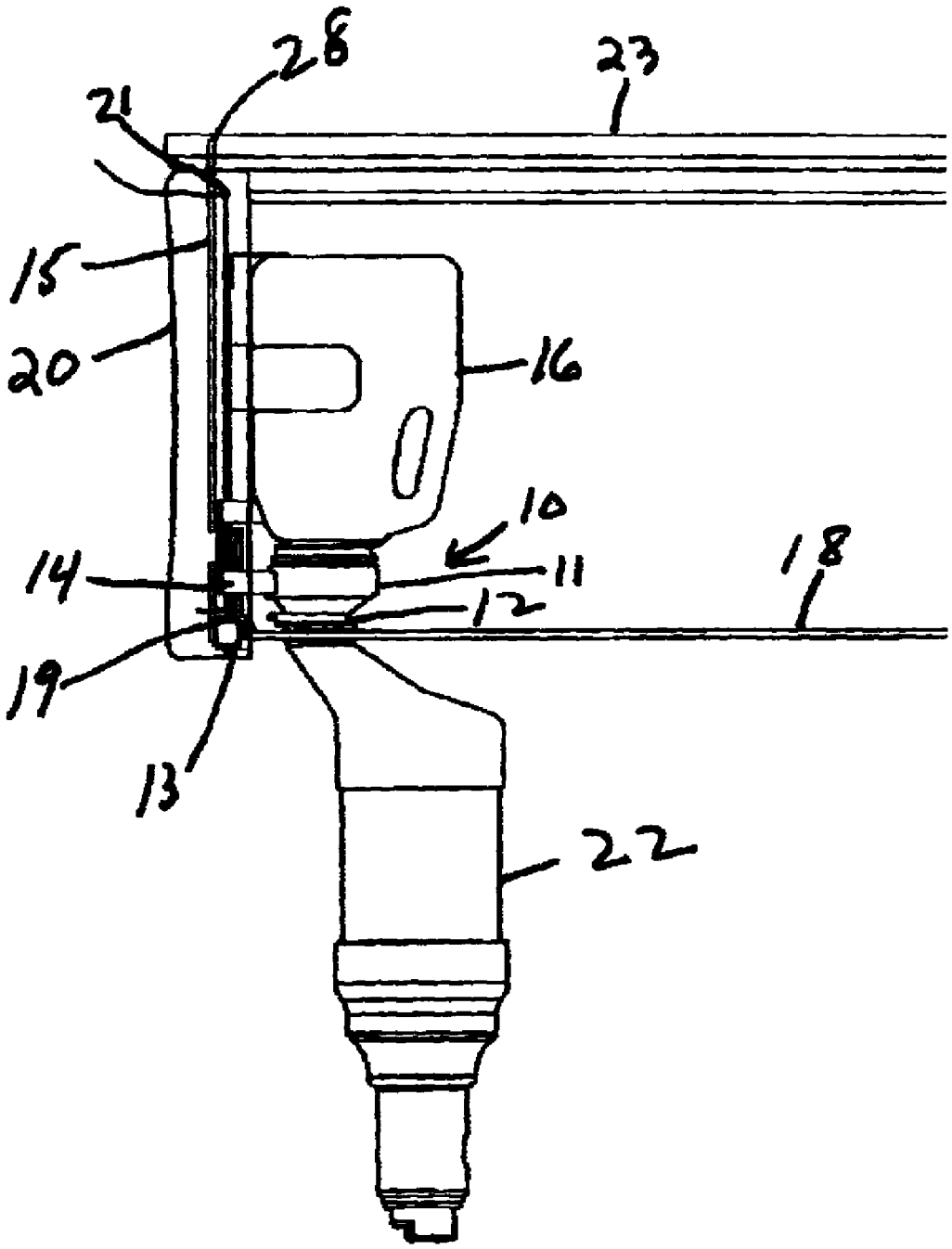
FIG. 6 shows the reservoir bottle support plate in a vertical position locked to the upright support plate, with the slide valve opened.
Figure 7:
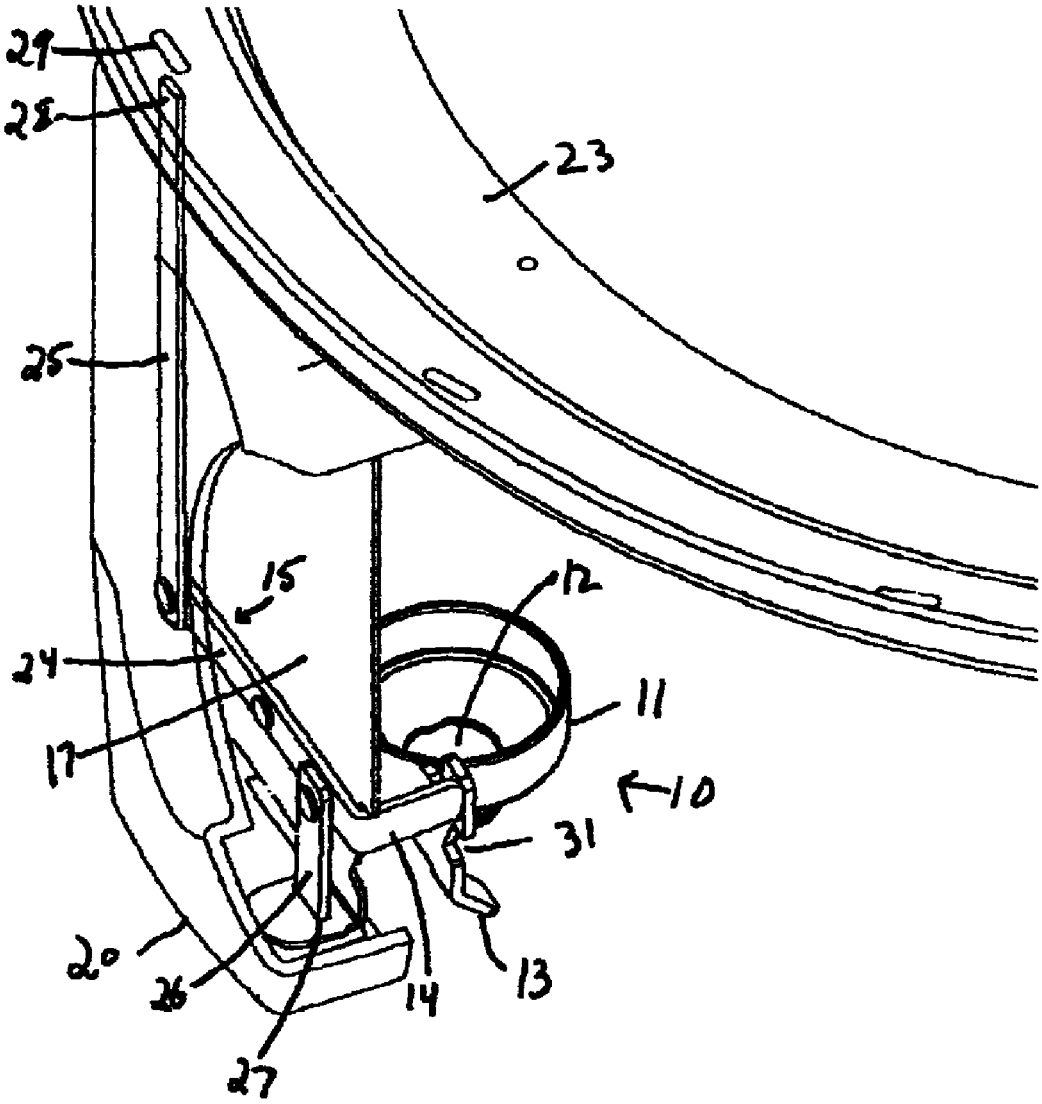
FIG. 7 shows a detailed view of the reservoir bottle support plate in an unlocked position and the slide valve closed.
Figure 8:
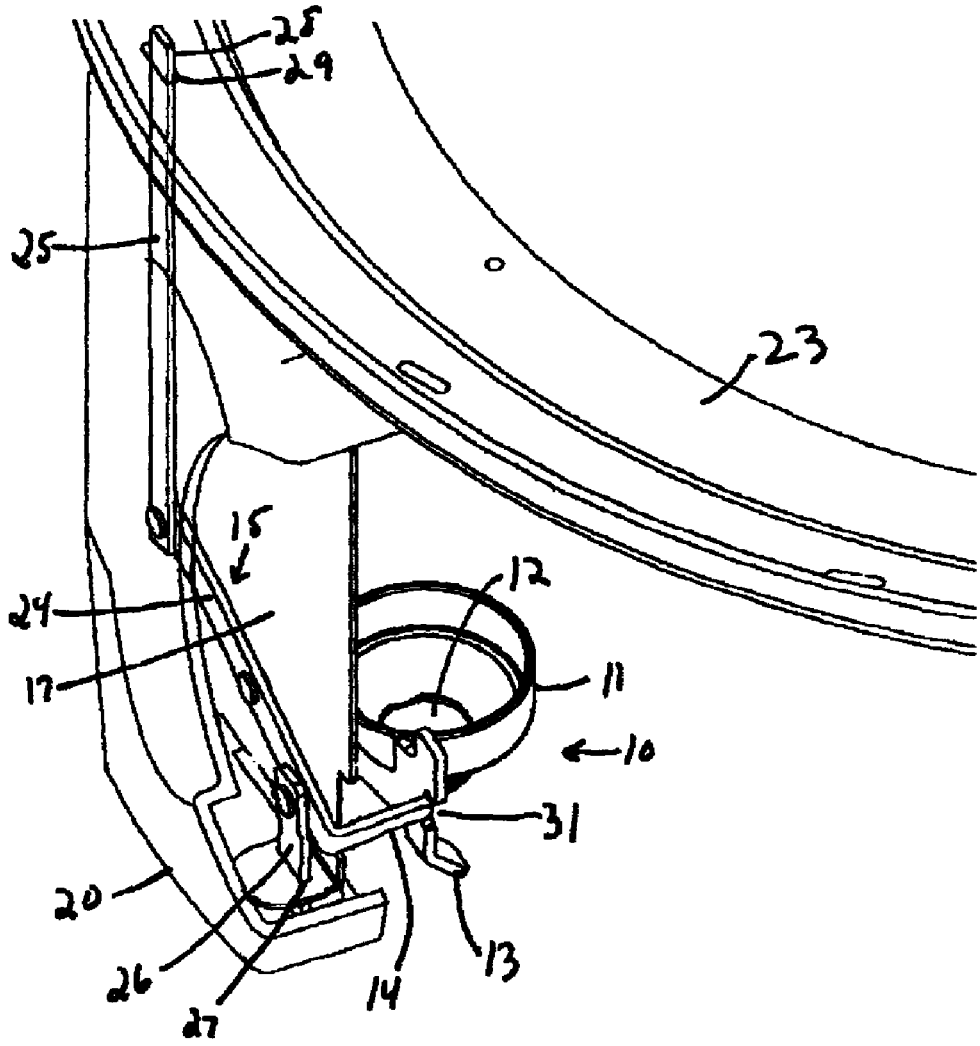
FIG. 8 shows a detailed view of the reservoir bottle support plate locked to the upper support plate and the slide valve closed.
Figure 9:
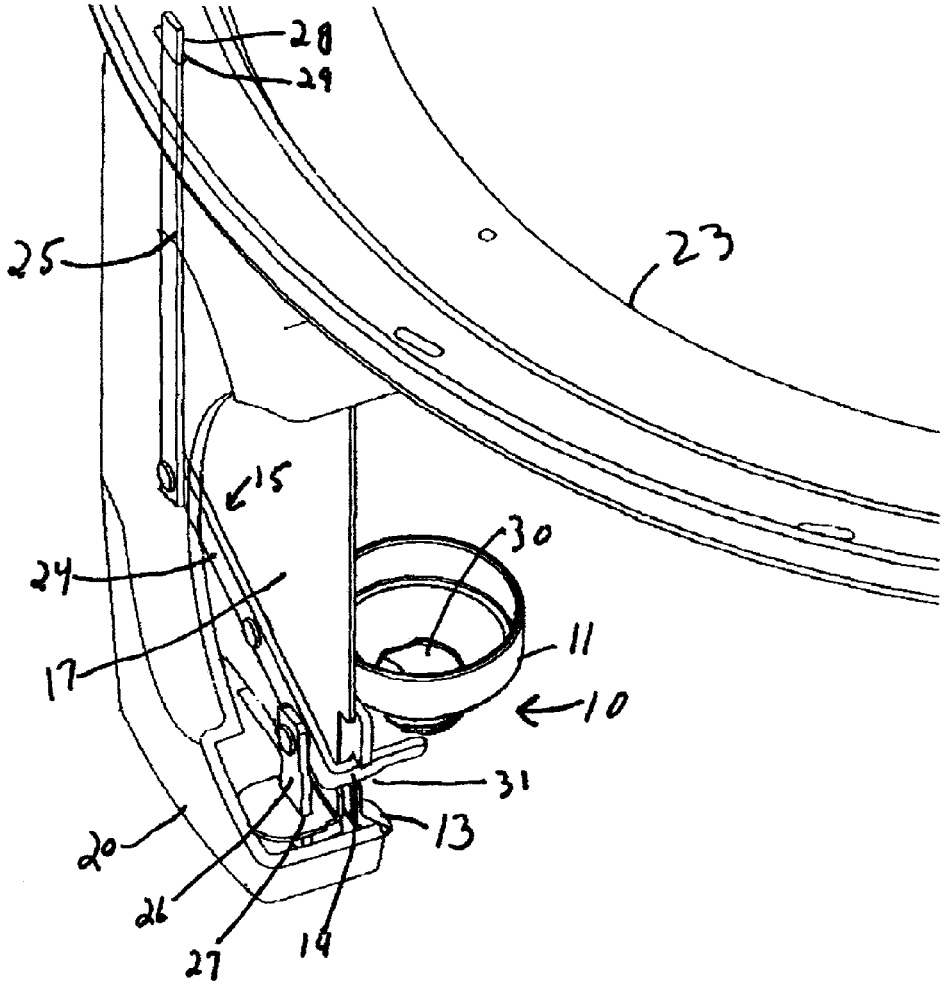
FIG. 9 shows a detailed view of the reservoir bottle support plate locked to the upper support plate and the slide valve opened.

FIG. 4 shows the reservoir bottle 16 inserted and in place over dispensing bottle 22. FIG. 4 further shows upper catch 28 which engages upper support plate 23 by means of slot 29 as shown in FIGS. 7-9. In FIG. 4 lock handle 14 is an unlocking position (see FIG. 7). In FIG. 5 lock handle 14 is in a locking position by being pushed downward towards dispensing bottle support plate 18, thereby locking support plate 17 to upper support plate 23 as upper catch 28 moves upward. Slide valve 10 remains closed, but lock handle 14 is in alignment with valve handle 13 so that slide valve 10 can be opened (see FIG. 8). FIG. 6 shows valve handle 13 pushed away from valve housing 11, thus sliding valve plate 12 off of the opening 30 in slide valve 10 (see FIG. 9), allowing the contents of reservoir bottle 16 to flow into dispensing bottle 22.

FIGS. 7-8 show the structure and operation of slide valve 10 in greater detail. In FIG. 7 reservoir bottle support plate 17 and cover 20 have been rotated upward in a vertical position so that reservoir bottle support plate 17 engages upper support plate 23. Upper support plate 23 has an upper catch slot 29 which receives upper catch 28 to lock the support plate 17 to upper support plate 23. Lock handle 14 is attached to an operating arm assembly 15 which is attached rotatably to reservoir bottle support plate 17. Operating arm assembly 15 is composed of a horizontal arm 24 which is attached rotatably to a vertical arm 25. Lock handle 14 is attached to the horizontal arm of the arm assembly. Also attached to the horizontal arm assembly 15 is a lower catch 26 which engages a lower catch slot 27 in a latch plate attached to cover 20.

FIG. 8 shows lock handle 14 pulled downwards towards dispensing bottle support plate 18 and to a locking position. This causes vertical arm 25 to move upward and horizontal arm 24 to move downwards, causing upper catch 28 to be inserted into upper catch slot 29 and lower catch 26 to be inserted in lower catch slot 27, thus locking support plate 17 and its cover into position. When lock handle 14 is pulled downwards towards dispensing bottle support plate 18 it comes into alignment with a notch 31 in valve handle 13. In this position, valve handle 13 can be pushed away from or towards valve housing 11. Since valve handle 13 is connected to valve plate 12, moving valve handle 13 away from the housing 11 will slide valve plate 12 off of the opening 30 in slide valve 10, thus opening slide valve 10. Moving valve handle 13 across lock handle 14 towards housing 11 will slide valve plate 12 onto the opening 30 in slide valve 10, thus closing slide valve 10.

FIG. 9 shows valve handle 13 pushed away from housing 11 so that lock handle 14 is fixed in a locking position in notch 31 of valve handle 13. Slide valve 10 has an opening 30 so that material in reservoir bottle 16 can flow freely into dispensing bottle 22. With lock handle 14 in this fixed locking position it is not possible to rotate reservoir bottle support plate 17 and reservoir bottle 16 away from dispensing bottle 22. In order to remove reservoir bottle 16 away from dispensing bottle 22 valve handle 13 must be pushed back towards housing 11 so that valve plate 12 closes opening 30 and notch 31 is, thus, moved off of lock handle 14. Lock handle 14 can then be lifted away from the dispensing bottle support plate to an unlocking position, withdrawing upper catch 28 from slot 29 and lower catch 26 from slot 27. Support plate 17 and reservoir bottle 16 can then be rotated away from dispensing bottle 22, but only with the slide valve 10 closed.

The foregoing description has been limited to specific embodiments of this invention. It will be apparent, however, that variations and modifications may be made by those skilled in the art to the disclosed embodiments of the invention, with the attainment of some of all of its advantages and without departing from the spirit and scope of the present invention. For example, slide valve 10 and its attachments can operate in any desired orientation. The components of slide valve 10 and its attachments can be made of plastic, metal, or a combination thereof. Slide valve 10 can be used with liquids, powders, and particulate material.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A slide valve for a bottle, comprising:

a) a housing with a valve plate, said housing being attached to a rotatable reservoir bottle support plate;

b) said housing having a valve handle which opens and closes said valve plate over an opening in said slide valve;

c) said reservoir bottle support plate being rotatably attached to a dispensing bottle support plate so that said reservoir bottle support plate can be rotated towards an upper support plate; and d) a lock handle connected to an operating arm assembly, said operating arm assembly being attached rotatably to said reservoir support plate to lock said reservoir support plate to said upper support plate when said lock handle is moved to a locking position.

2. The slide valve of claim 1 wherein said valve handle opens and closes said valve plate only when said lock handle is in said locking position.

3. The slide valve of claim 1 wherein said valve handle has a notch which engages said lock handle so that said valve handle can move back and forth across said lock handle to open or close said valve plate when said lock handle is in said locking position.

4. The slide valve of claim 1 wherein said operating arm assembly has a horizontal arm, said horizontal arm having a lower catch which engages a lower catch slot in said reservoir support plate when said lock handle is in said locking position, and a vertical arm, said vertical arm having an upper catch which engages an upper catch slot in said upper support plate when said lock handle is in said locking position.

5. The slide valve of claim 1 wherein said valve plate is locked in a closed position over said opening in said slide valve only when said lock handle is in an unlocking position, and said lock handle is in an unlocking position only when said valve plate is in a closed position over said opening in said slide valve.

6. The slide valve of claim 1 wherein said lock handle is in a locking position when moved towards said dispensing bottle support plate, and in an unlocking position when moved away from said dispensing bottle support plate.

7. The slide valve of claim 1 wherein a reservoir bottle on said reservoir support plate engages said slide valve on one end of said slide valve and a dispensing bottle on said dispensing bottle support plate engages said slide valve on an opposite side of said slide valve so that the contents of the reservoir bottle flow into the dispensing bottle as said valve handle moves said valve plate to open said slide valve when said lock handle is in said locking position.

8. A slide valve for a bottle, comprising:

a) a housing with a valve plate, said housing being attached to a rotatable reservoir bottle support plate;

b) said housing having a valve handle which opens and closes said valve plate over an opening in said slide valve;

c) said reservoir bottle support plate being rotatably attached to a dispensing bottle support plate so that said reservoir bottle support plate can be rotated towards an upper support plate;

d) a lock handle connected to an operating arm assembly, said operating arm assembly being attached rotatably to said reservoir support plate to lock said reservoir support plate to said upper support plate when said lock handle is moved to a locking position;

e) said valve handle opening and closing said valve plate only when said lock handle is in said locking position; and f) said operating arm assembly having a horizontal arm, said horizontal arm having a lower catch which engages a lower catch slot in said reservoir support plate when said lock handle is in said locking position, and a vertical arm, said vertical arm having an upper catch which engages an upper catch slot in said upper support plate when said lock handle is in said locking position.

9. The slide valve of claim 8 wherein said valve handle has a notch which engages said lock handle so that said valve handle can move back and forth across said lock handle to open or close said valve plate when said lock handle is in said locking position.

10. The slide valve of claim 8 wherein said valve plate is locked in a closed position over said opening in said slide valve only when said lock handle is in an unlocking position, and said lock handle is in an unlocking position only when said valve plate is in a closed position over said opening in said slide valve.

11. The slide valve of claim 8 wherein said lock handle is in a locking position when moved towards said dispensing bottle support plate, and in an unlocking position when moved away from said dispensing bottle support plate.

12. The slide valve of claim 8 wherein a reservoir bottle on said reservoir support plate engages said slide valve on one end of said slide valve and a dispensing bottle on said dispensing bottle support plate engages said slide valve on an opposite side of said slide valve so that the contents of the reservoir bottle flow into the dispensing bottle as said valve handle moves said valve plate to open said slide valve when said lock handle is in said locking position.

13. A slide valve for a bottle, comprising:

a) a housing with a valve plate, said housing being attached to a rotatable reservoir bottle support plate;

b) said housing having a valve handle which opens and closes said valve plate over an opening in said slide valve;

c) said reservoir bottle support plate being rotatably attached to a dispensing bottle support plate so that said reservoir bottle support plate can be rotated towards an upper support plate;

d) a lock handle connected to an operating arm assembly, said operating arm assembly being attached rotatably to said reservoir support plate to lock said reservoir support plate to said upper support plate when said lock handle is moved to a locking position;

e) said valve handle opening and closing said valve plate only when said lock handle is in said locking position, said valve handle having a notch which engages said lock handle so that said valve handle can move back and forth across said lock handle to open or close said valve plate when said lock handle is in said locking position;

f) said operating arm assembly having a horizontal arm, said horizontal arm having a lower catch which engages a lower catch slot in said reservoir support plate when said lock handle is in said locking position, and a vertical arm, said vertical arm having an upper catch which engages an upper catch slot in said upper support plate when said lock handle is in said locking position; and g) said valve plate being locked in a closed position over said opening in said slide valve only when said lock handle is in an unlocking position, and said lock handle is in an unlocking position only when said valve plate is in a closed position over said opening in said slide valve.

14. The slide valve of claim 13 wherein said lock handle is in a locking position when moved towards said dispensing bottle support plate, and in an unlocking position when moved away from said dispensing bottle support plate.

15. The slide valve of claim 13 wherein a reservoir bottle on said reservoir support plate engages said slide valve on one end of said slide valve and a dispensing bottle on said dispensing bottle support plate engages said slide valve on an opposite side of said slide valve so that the contents of the reservoir bottle flow into the dispensing bottle as said valve handle moves said valve plate to open said slide valve when said lock handle is in said locking position.

16. A slide valve for a bottle, comprising:

a) a housing with a valve plate, said housing being attached to a rotatable reservoir bottle support plate;

b) said housing having a valve handle which opens and closes said valve plate over an opening in said slide valve;

c) said reservoir bottle support plate being rotatably attached to a dispensing bottle support plate so that said reservoir bottle support plate can be rotated towards an upper support plate;

d) a lock handle connected to an operating arm assembly, said operating arm assembly being attached rotatably to said reservoir support plate to lock said reservoir support plate to said upper support plate when said lock handle is moved to a locking position;

e) said lock handle being in a locking position when moved towards said dispensing bottle support plate, and in an unlocking position when moved away from said dispensing bottle support plate;

f) said valve handle opening and closing said valve plate only when said lock handle is in said locking position, said valve handle having a notch which engages said lock handle so that said valve handle can move back and forth across said lock handle to open or close said valve plate when said lock handle is in said locking position;

g) said operating arm assembly having a horizontal arm, said horizontal arm having a lower catch which engages a lower catch slot in said reservoir support plate when said lock handle is in said locking position, and a vertical arm, said vertical arm having an upper catch which engages an upper catch slot in said upper support plate when said lock handle is in said locking position; and h) said valve plate being locked in a closed position over said opening in said slide valve only when said lock handle is in an unlocking position, and said lock handle is in an unlocking position only when said valve plate is in a closed position over said opening in said slide valve.

17. The slide valve of claim 16 wherein a reservoir bottle on said reservoir support plate engages said slide valve on one end of said slide valve and a dispensing bottle on said dispensing bottle support plate engages said slide valve on an opposite side of said slide valve so that the contents of the reservoir bottle flow into the dispensing bottle as said valve handle moves said valve plate to open said slide valve when said lock handle is in said locking position.

* * * * *